US006599181B2

(12) United States Patent
Abe et al.

(10) Patent No.: US 6,599,181 B2
(45) Date of Patent: Jul. 29, 2003

(54) COIN DISPENSING APPARATUS WITH AN ADJUSTABLE DISPENSER UNIT FOR ACCOMMODATING DIFFERENT SIZE COINS

(75) Inventors: Hiroshi Abe, Iwatsuki (JP); Takashi Inozuka, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 0 days.

(21) Appl. No.: 09/906,307

(22) Filed: Jul. 16, 2001

(65) Prior Publication Data

US 2002/0013127 A1 Jan. 31, 2002

(30) Foreign Application Priority Data

Jul. 17, 2000 (JP) ..... 2000-215969

(51) Int. Cl.[7] ..... G07D 9/04
(52) U.S. Cl. ..... 453/32; 194/334; 221/267
(58) Field of Search ..... 453/32, 50, 57; 194/344; 221/267

(56) References Cited

U.S. PATENT DOCUMENTS

| | | | | |
|---|---|---|---|---|
| 4,518,001 A | | 5/1985 | Branham | |
| 4,592,377 A | | 6/1986 | Paulsen et al. | |
| 4,943,258 A | | 7/1990 | Abe | |
| 5,181,881 A | * | 1/1993 | Abe | 194/344 |
| 5,435,778 A | * | 7/1995 | Castle et al. | 221/267 |
| 5,484,334 A | * | 1/1996 | Evdokimo | 221/203 |
| 5,662,520 A | * | 9/1997 | Evdokimo | 453/3 |
| 5,810,655 A | * | 9/1998 | Suzukawa et al. | 221/252 |
| 5,876,275 A | | 3/1999 | Rasmussen | |
| 5,931,732 A | * | 8/1999 | Abe et al. | 221/252 |
| 6,059,651 A | * | 5/2000 | Abe et al. | 221/267 |
| 6,080,057 A | * | 6/2000 | Bell et al. | 221/203 |
| 6,261,170 B1 | * | 7/2001 | Bell et al. | 194/344 |

FOREIGN PATENT DOCUMENTS

| | | | | |
|---|---|---|---|---|
| JP | 05073748 A | * | 3/1993 | G07D/1/00 |
| JP | 05073749 A | * | 3/1993 | G07D/1/00 |

* cited by examiner

*Primary Examiner*—Kathy Matecki
*Assistant Examiner*—Sang Kim

(57) ABSTRACT

A coin dispensing apparatus includes a storage interior for storing bulk coins, a coin passageway extending along a vertical longitudinal axis upward from the storage container to an exit aperture, and a coin selector for selectively sending coins upward along the coin passageway. A lever is pivotably mounted for contacting the coin as it exits the exit aperture, and a sensor unit operatively connected with the lever can count the coins as they exit. The lever and the sensor unit can be appropriately aligned in a fixed relationship and a mounting assembly that is mounting the lever and the sensor unit adjacent the exit aperture can be adjusted traverse to to the longitudinal axis to accommodate different size coins.

14 Claims, 4 Drawing Sheets

[Fig. 1]
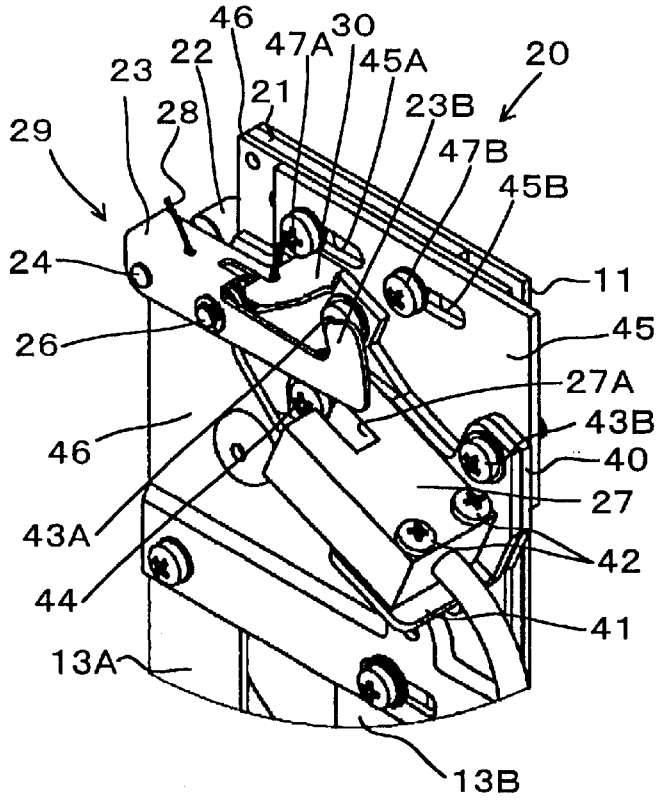
[Fig. 2]
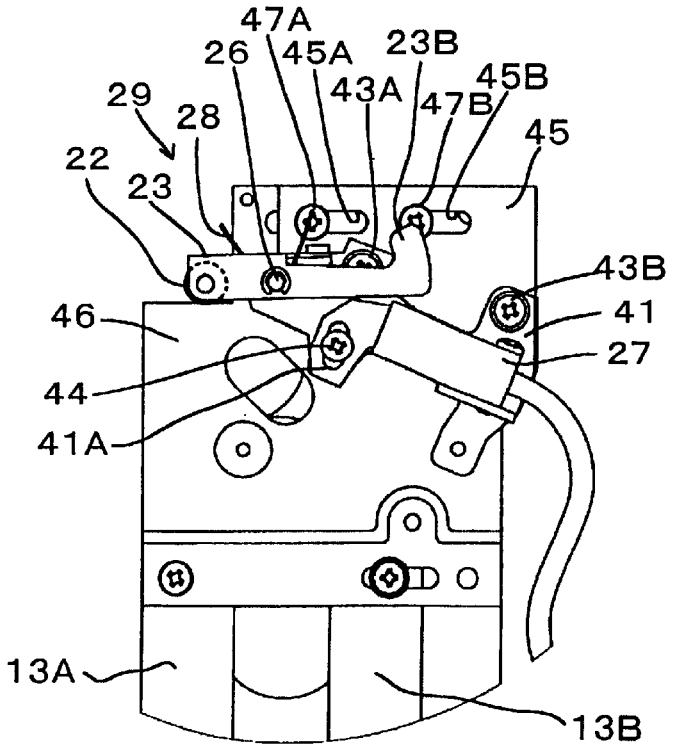

[Fig. 3]
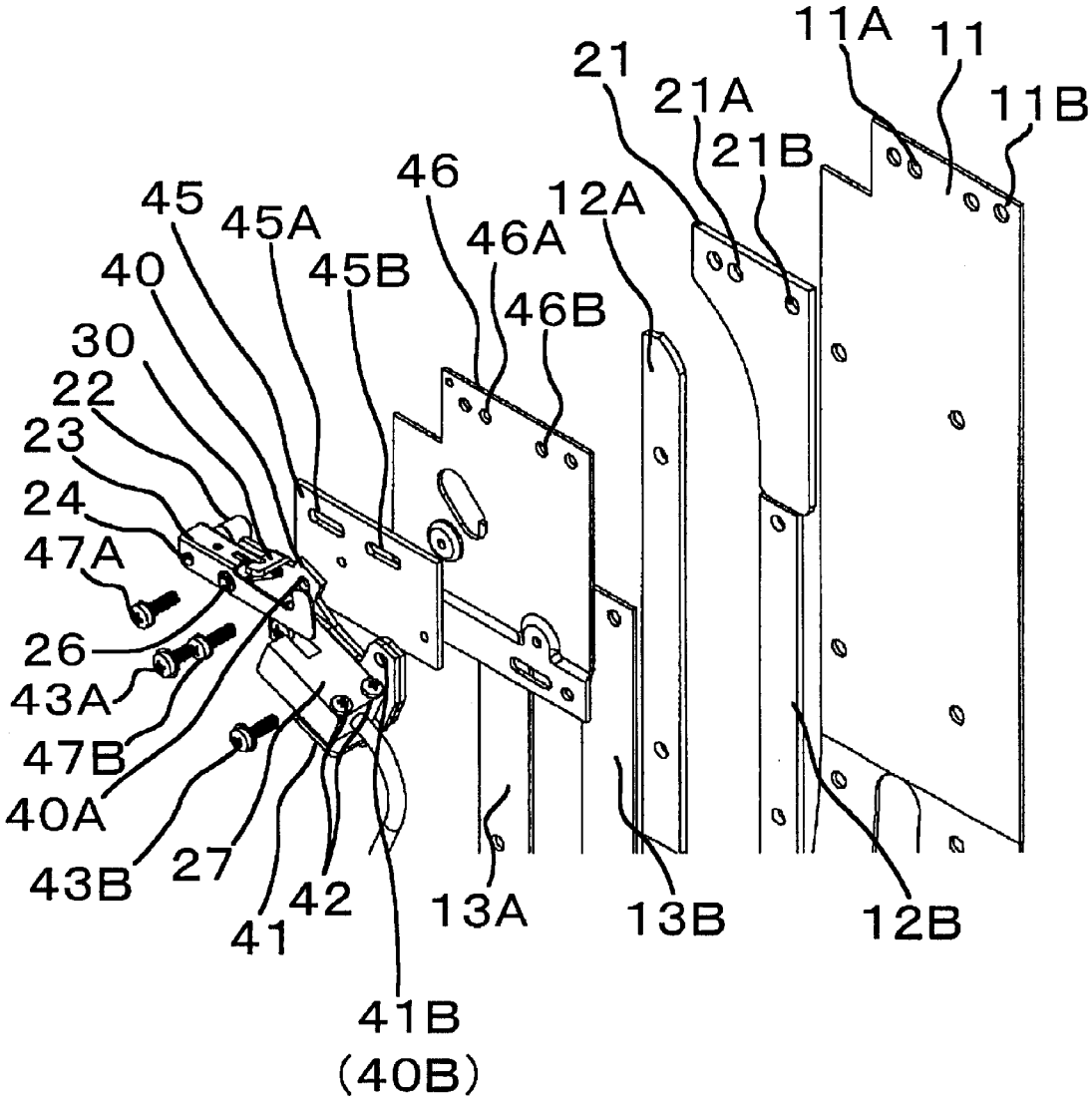

[Fig. 4]
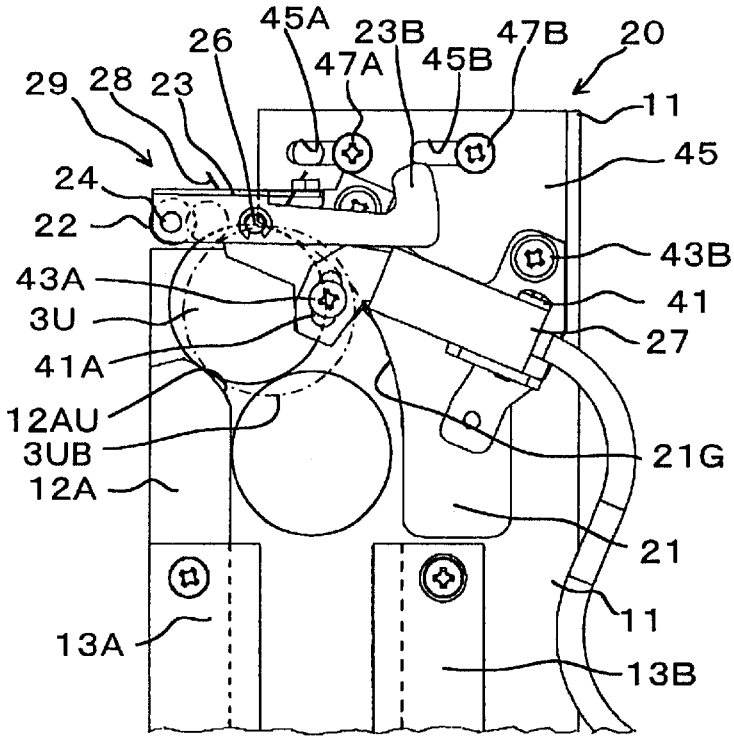
[Fig. 5]
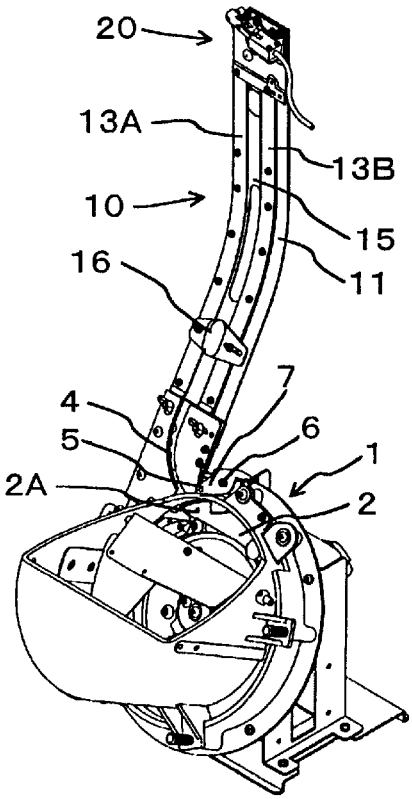

[Fig. 6]
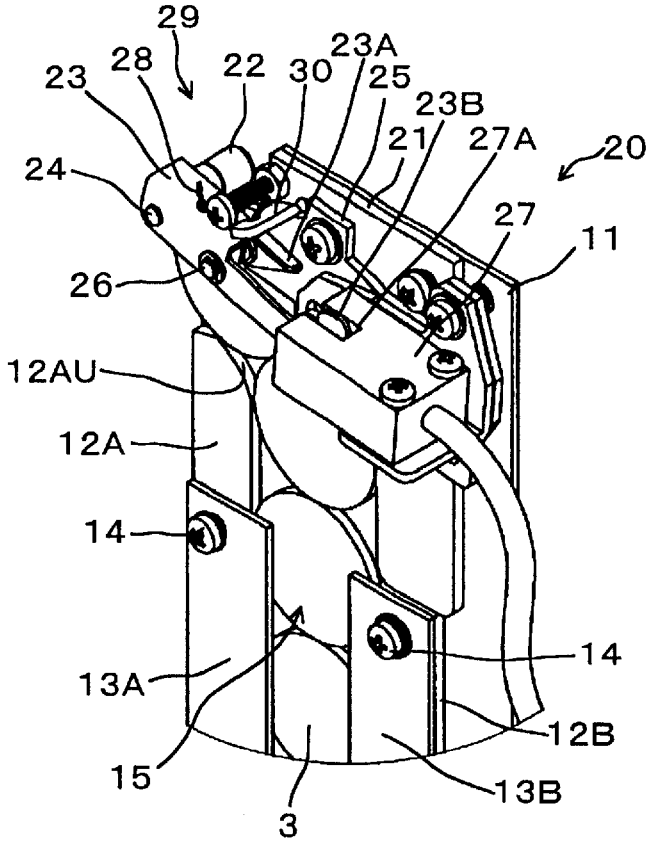
[Fig. 7]
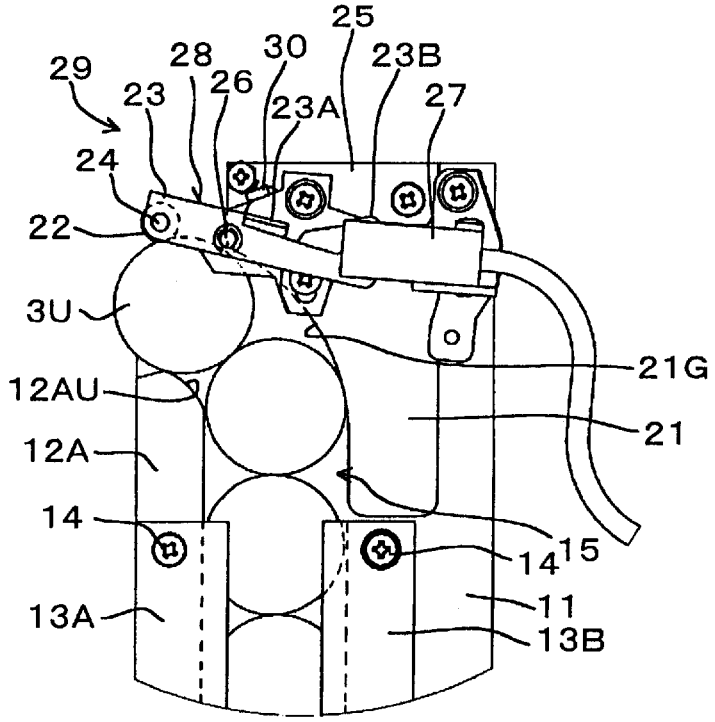

COIN DISPENSING APPARATUS WITH AN ADJUSTABLE DISPENSER UNIT FOR ACCOMMODATING DIFFERENT SIZE COINS

BACKGROUND OF THE INVENTION

1. Field of the Invention

The present invention is in the field of coin dispensing apparatus where coins are dispensed from a storage container through a coin passageway with an exit aperture, and more particularly to a compact mounting assembly that can mount both a pivoting lever that extends within the coin exit aperture and a sensor unit which can be adjusted transverse to a longitudinal axis of the passageway to accommodate different size coins.

2. Background of the Invention

Various forms of devices utilize coin handling and payout apparatus, such as slot machines, gaming devices, and money change apparatus. Coins, medallions, or tokens are usually dispensed from a storage container by a selector mechanism through a coin passageway to a coin exit aperture. The coin passageway can be elevated relative to the storage container or coin hopper so that the coins are pushed up in a single edge-to-edge file or stack through the passageway. Various devices have been provided to provide security without jamming the dispensing of the coins from the exit aperture.

Referring to FIG. 5, a coin hopper or bowl 1 can store loose coins in bulk. A coin selector device, such as a rotating disk 2, can selectively pick up coins from the coin hopper to direct them towards an escalator 10. Individual coins can be stopped at a protrusion 2*a* which is located adjacent to the rotating disk at the entrance to the escalator 10. The protrusion 2*a* can direct the coin to contact a return prevention roller 5 which governs the entrance outlet to the escalator 10. The return prevention roller 5 is installed at the tip or edge of a rotating lever 7 that rotates about a fixed shaft 6. While not illustrated in FIG. 5, a spring can provide a biasing force to rotate the lever 7 in a counter-clockwise direction. The escalator 10 extends upward from the outlet 4. The escalator 10 can be formed from an elongated base member 11, spacers 12A and 12B, and maintenance boards 13A and 13B. The dimensions of the spacers 12A and 12B are slightly thicker than the thickness of the coin to be guided along the escalator 10. Additionally, the spacers 12A and 12B are spaced outwardly, from a longitudinal axis of the passageway, to be slightly larger than the diameter of the coin to form a coin passageway or guide for a series of stacked coins as they are progressively passed upward along the escalator 10. The maintenance boards 13A and 13B can be held by appropriate fasteners, such as screws, to the sides of the base 11 with the spacers 12A and 12B installed on the base 11. The resultant configuration provides a cross-sectional rectangular guide path for coins of a predetermined diameter and thickness.

Mounted adjacent the exit aperture of the coin passageway is a dispensing unit fixed to the maintenance boards 13A and 13B of a type of structure, for example, as disclosed in U.S. Pat. No. 4,943,258. An upper end portion of the guide passageway 15, shown in FIG. 7, can have a curved surface 21G formed in a guide piece 21. A lower curved upper end portion 12AU of a spacer 12A can complete the formation of the exit aperture. Thus, the upper end division of the guide passageway 15 will curve in a leftward direction, as shown in FIG. 7.

Referring to FIG. 6, a coin sensor 20 is provided with a pivoting lever 23 that rotates about a shaft 26, while supporting a control roller 22 at its tip. The control roller 22 rotates about a shaft 24 at the end of the lever 23. The shaft 26 can be mounted on a bracket 25 which, in turn, is fixed to the base 11. The control roller 22 is located at the exit of the respective curved planes of the spacers 12A and guide piece 21. A sensor unit 27 can output a detection signal upon detection of an edge 23B of the lever 23 when it is moved within a detection groove 27A. The lever 23 can receive a biasing force by a spring 28. The dispenser assembly 29 has a structure composed of the control roller 22, the lever 23, and the biasing spring 28. A stopper 30 protruding from the bracket 25 can stop the rotation of the lever 23.

As can be seen, the control roller 22 at the end of the lever 23 protrudes into the exit of the guide passageway 15 when a coin is not in contact with the control roller 22. At this time, the detection edge 23B of the lever 23 is displaced from the detection groove 27A.

Referring to FIGS. 5, 6, and 7, the protrusion 2A on the rotating disk 2 in the storage hopper will selectively push coins 3 towards the exit 4. The return prevention roller 5 is pushed up to permit a coin 3 to pass into the coin passageway. As additional coins 3 are inserted into the passageway, the lowest coin of the coin passageway will push the upper coins upward in the guide passageway 15. Eventually, the highest coin 3U, shown in FIG. 7, will be ejected from the guide passageway 15. As it is being ejected, it will contact the control roller 22 and force the lever 23 to rotate in a clockwise direction, as shown in FIG. 7.

The detection edge 23B will be moved within the detection groove 27A and thereby cause the sensor 27 to output a detection signal representative of the presence of a coin. The lever 23 is biased by spring force of the spring 28 in a counter-clockwise direction so that the control roller 23 will rotate across the periphery of the coin 3U. Meanwhile, at the storage hopper, the return prevention roller 5 will stop the return of any coins in the guide passage 15.

As can be appreciated, it is desirable for the coins to be loaded within the guide passageway 15 so that they are immediately available for discharge, but it is also important that the detection signal not be activated until the coin actually is in the process of being ejected. As can be appreciated, the positional relationship between the highest coin 3U and the control roller 22 will depend on the path length from the return prevention roller 5 to the control roller 22 and the diameter of the coin 3. If the diameter of the coins is relatively large, they could cause the control roller 22 to stop in a contact condition that will activate a sensor output. Thus, an adjustment to accommodate different size coins is necessary in such a coin dispenser.

U.S. Pat. No. 5,876,275 represent a proposed solution to this adjustment problem. The coin sensor 20 is mounted for longitudinal adjustment relative to the position of the escalator 10. Accordingly, the positional relationship between the highest coin 3U and the control roller 22 can be adjusted by adjusting the length of the guide passage 15. The housing which surrounds the escalator must have sufficient vertical adjustment space to permit a height correction to provide this adjustment.

Other examples of the prior art structure can be found in U.S. Pat. No. 4,518,001 and U.S. Pat. No. 4,592,377.

The requirement of a compact configurations with adjustments to accommodate different size coins still remains an issue in the prior art.

SUMMARY OF THE INVENTION

The present invention seeks to ensure an accurate output from a sensor unit in detecting the condition of a coin discharge without changing the vertical length of the escalator or coin passageway.

To achieve this structure, the present invention provides a storage container for storing coins and an escalator or coin passageway extending along a longitudinal axis upward from the storage container to an exit aperture. A coin selector can be mounted within the storage container and send a coin into the coin passageway wherein a series of stacked coins can be advanced for discharge through the exit aperture. A dispenser unit can be located in the exit of the coin passageway and can include a lever pivotedly mounted for contacting the coin as it exits the exit aperture and a sensor unit for counting the coins. A mounting assembly can mount the lever and the sensor unit adjacent the exit aperture for adjustment transverse to the longitudinal axis of the coin passageway to accommodate different size coins without increasing the overall height of the combined dispenser unit and coin passageway. The mounting assembly can include a base member for movably mounting the dispenser unit to permit an adjustment transverse to the longitudinal axis of the passageway and a fastener member for releasably securing the base member to the coin passageway.

Such an arrangement does not change the overall length of the coin passageway or guide passage but permits a change in the relative position between the coin control roller on the lever and the specific size of the coins. Thus, this installation alignment permits a lateral adjustment of the control roller in configurations wherein it is not possible to provide space to permit an adjustment in a vertical height direction. This ensures that appropriate detection signals are not generated while accommodating different size coins. The dispenser unit can further comprise a lever with a rotatable roller installed at its tip and a shaft that can permit free rotation of the lever. A spring can be used to bias the lever into the coin passageway while a sensor unit can detect the relative movement of the lever to provide a coin detection signal. A base member can support both the shaft, lever, spring, and sensor unit with elongated holes to permit a lateral transverse adjustment to the longitudinal axis of the guide passage. Accordingly, an adjustment is easy, because it is possible for a readjustment of both the lever and the sensor unit without increasing the overall combined height or vertical length of the escalator or coin passageway.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 1 is a perspective view of the dispenser unit and mounting assembly of the present invention;

FIG. 2 is an elevated partial view of FIG. 1;

FIG. 3 is an exploded perspective view of the dispenser unit mounting base member and upper structure of the escalator;

FIG. 4 is an elevated view of the dispenser unit laterally adjusted in a traverse direction relative to FIG. 2;

FIG. 5 is a perspective view of a coin hopper dispenser;

FIG. 6 is a partial perspective view of a dispenser unit of the prior art; and FIG. 7 is an elevated plan view of dispenser unit of the prior art.

DETAILED DESCRIPTION OF THE PREFERRED EMBODIMENT

The following description is provided to enable any person skilled in the art to make and user the invention and sets forth the best modes contemplated by the inventors of carrying out their invention. Various modifications, however, will remain readily apparent to those skilled in the art, since the general principles of the present invention have been defined herein specifically to provide a coin dispensing apparatus with an adjustable dispenser unit for accommodating different size coins.

The coin dispenser apparatus of the present invention can utilize some of the common elements disclosed in the prior art, such as the storage container, coin selector, and escalator or coin passageway, as shown, for example, in FIG. 5. Accordingly, the common elements will be described with the same reference numbers as utilized in the Background of the Invention.

The present invention, as shown in FIGS. 1–4, includes the base plate 11 which can mount the appropriate spacers 12A and 12B and the maintenance boards 13A and 13B. The spacers and the maintenance boards can be adjusted or additional spacers of a different size can be utilized to accommodate different diameter coins. The terminology "Coin" as used in the present invention includes medallions, tokens, and other articles in addition to monetary coins that can be stored in bulk and dispensed through a guide passageway.

As can be seen in FIG. 3, the base member 11 can mount the spacers 12A and 12B and the guide piece 21 with the overlying maintenance boards 13A and 13B. An adapter plate 40 that is aligned parallel with the base 11 can support a fixation shaft 26. A cover member 46 having an upper left hand notch can be mounted by appropriate screws directly on the maintenance boards 13A and 13B, as shown in FIG. 2. An elongated slot at the bottom of the cover member 46 can accommodate different spacing of the maintenance boards 13A and 13B. Holes 46A and 46B are provided along an upper edge.

As can be seen in FIG. 1, a contact roller at the end of the lever arm 23 is juxtapositioned to extend into the exit aperture and accommodated by the notch in the upper left hand corner of cover plate 46. An installation alignment base member 45 having a pair of elongated holes 45A and 45B is adapted to be releasably mounted to and laterally slid across the face of a cover member 46.

A dispensing unit 29 includes a lever 23 that can be pivotedly moved for placing the coin contacting control roller 22 across the exit aperture of the guide passage 15. A spring 28 can bias the rotation of the lever 23 about its fixation shaft 26 and also can provide an ejection force in assisting the coin 3U to be ejected in a leftward direction. An adapter plate 40 can interconnect the operation of the lever 23 and a sensor unit 27 that can be mounted on an L-shaped bracket 41. A fixation shaft 26 is fixed in the adapter plate 40 to permit the rotation or pivoting of the lever 23. The lever arm rotates in a plane parallel to a plane containing a base 11. The shaft 24 supports rotation of the contact roller 22. At a distal end of the lever 23, a detection edge 23B is provided. The sensor unit 27 includes a groove 27*a*, as shown in FIG. 1, which is aligned with the plane of movement of the lever 23 so that the detection edge 23B can operatively pass into and out of the detection groove 27A. As can be determined, a positional alignment of the lever 23 and the sensor unit 27 can be established with its mounting on the adapter plate 40. The adapter plate 40 can also support a stopper 30 which extends at a perpendicular angle to the plane of the base 11 to limit the movement of the lever arm 23.

Fasteners 42 can secure the sensor unit 27 and the L-shaped bracket 41. The adapter plate 40 can be fixed to the installational alignment base 45 which is also aligned in parallel with the plane containing the base 11. Fasteners 43A and 43A can pass through holes of 40A and 40B (40B overlaps with the hole 41B, shown in FIG. 3). The fasteners can be secured within threaded holes in the mounted base member 45.

The fastener 43B which can extend through the hole 41B, shown in FIG. 3, sets the fixing bracket 41 that supports the sensor unit 27 on the installation alignment base 45. An elongated hole 41A is aligned in the vertical plane in an arc configuration and is formed on the mounting bracket 41. The hole 41B is centrally aligned with the elongated arc opening and a fastener 44 can extend through the elongated hole 41A to be screwed into the adapter plate 40. The bracket 41 is then fixed by the fastener or screw 44 and the fastener or screw 43B. As can be appreciated, the bracket 41 can rotate or pivot about the anchor location of the screw 43B. Thus, by rotation of the bracket 41 it is possible to adjust the mounting angle of the sensor unit 27 on the adapter plate 40. This permits a positional relationship between the detector edge 23B of the lever 23 and the groove in the sensor unit 27 to be relatively adjusted. Fasteners 47A and 47B can screw within threaded holes 11*a* and 11*b* in the base 11. The fasteners 47A and 47B are thereby removably attached to fix the base 45, the cover 46, and the guide piece 21.

The position of the control roller 22 on the lever arm 23 can be horizontally adjusted by movement along the length of the elongated holes 45A and 45B. This adjustment is accommodated by the notch at the upper left hand corner of the cover 46. The guide board or cover 46 guides coins 3 which pass through the maintenance board 13A and 13B to form the final exit aperture for the coins.

Referring to FIG. 4, an example is shown wherein the uppermost coin 3U of a certain diameter is accommodated. By loosening the fasteners 47A and 47B, the base member 45 can be moved transverse to the longitudinal axis of the guide passage 15 in a horizontal direction by the length of the elongated holes 45A and 45B. Thus, the desired position of the control roller 22 can be adjusted so that it is in the path of the uppermost coin 3U but the distal end 23B of the lever end 22 is not being displaced to interact with the sensor unit 27. When this desired position is reached, the fasteners 47A and 47B are tightened so that the alignment based 45 is then fixed for the particular diameter of the coins.

In this condition, when a coin is discharged by the selector unit or rotating disk 2 into the guide passage 15, the highest coin 3U is then guided by the curved plane 12AU and the guide plane 21G. The highest coin is then ejected in a left traverse direction and during this action, the lever 23 is rotated in a clockwise rotation since the control roller 22 is pushed up by the coin 3U. The detection edge 23*b* is then lowered into the detection groove 27*a* of the sensor unit 27. The lever arm 23 is biased by the spring force of the spring 28 so that when the coin 3U begins passing the leftward of the control roller 22, the control roller 22 is then biased downward to further urge the coin 3U to be ejected in the leftward direction. The next coin then becomes the highest coin 3U and the condition of FIG. 4 is repeated with the sensor unit 27 monitoring a predetermined number of coins that are to be ejected.

Referring again to FIG. 4, if the guide passage 15 is dimensioned to accept a larger size as shown by the dash lines of coin 3UB, then it is necessary for the base 45 to be moved transverse to the longitudinal axis of the passage guide 15 along the elongated holes 45A and 45B towards the right in a horizontal direction. Accordingly, the fasteners 47A and 47B are untightened so that the control roller 22 is then moved to the desired position which will be close to the uppermost coin 3UB. In FIG. 4, only the movement of the control roller 22 is illustrated by a dash line to ensure clarity in the drawing description. As can be seen, this adjustment for a larger coin does not vary the vertical height of the combined escalator and coin dispenser since the alignment plate 45 is slid in a horizontal plane and in a direction transverse to the longitudinal axis of the guide passage 15. When the desired position is achieved, so that the sensor unit 27 is not activated, but the control roller 22 is appropriately positioned within the exit aperture to engage the coin 3UB when it is being ejected, the fasteners 47A and 47B are again tightened so that the alignment base 45 becomes fixed.

As can be determined, by combining the sensor unit 27 with the dispenser unit 29 which includes the control roller 22, the pivoting lever 23, and the biasing springs 28 as a fixed group, it can be integrally moved by simply sliding in the horizontal direction which the alignment base 45. It is not necessary for a service person in the field to adjust again the positional relationship between the detection edge 23B and the sensor unit 27.

As can be understood, the position of the spacer 12B and the guide base 21 can be changed to adjust for coins of different diameter sizes. As can be further appreciated, the present invention need not have elongated holes in the base member 45, but rather a plurality of holes which will accommodate the fasteners 47A and 47B can be formed in the base 11.

Needless to say, the sensor unit 27 can employ a photoelectric, magnetic, resistance, or other conventional sensor units that detect the position of coins. It is also possible to use for the dispenser unit 29, a modified roller 22 that may move along a guide rail. In this case, the modified roller 22 can adopt a structure in which an installation alignment is integrally possible with the provision of a guide rail.

As can be appreciated, other variations of the present invention can be accomplished within the scope of the present disclosure without altering the housing equipment that accommodates a coin dispenser unit of the fixed vertical dimension.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. In a coin dispensing apparatus having a coin selector for sending coins along a coin passageway from a storage container to an exit aperture, the improvement comprising:

a dispenser unit having a member for contacting a coin as the coin is ejected through the exit aperture and a sensor assembly for providing a signal for each ejected coin;

a base member for movably mounting the dispenser unit to provide adjustment transverse to a longitudinal axis of the coin passageway without extending a vertical length of the coin passageway; and a fastener member for releasably securing the base member.

2. The invention of claim 1, wherein the base member is a support plate having at least one elongated aperture extending traverse to the longitudinal axis.

3. The invention of claim 2, wherein the coin passageway extends vertically from the storage container and the support plate is mounted at a distal end of the coin passageway relative to the storage container.

4. The invention of claim 1, wherein the sensor assembly includes a pivoting lever for contacting a coin as the coin is ejected.

5. The invention of claim 4, wherein the pivoting lever includes a roller at one end to contact the coin as the coin is ejected.

6. A coin dispensing apparatus comprising:

a storage container for storing coins;

a coin passageway having a longitudinal axis extending upward from the storage container to an exit aperture;

a coin selector for selecting a coin from the storage container and sending the coin to the coin passageway;

a lever pivotally mounted for contacting the coin as it exits the exit aperture;

a sensor unit for counting the coin as it exits the exit aperture; and a mounting assembly for mounting the lever and the sensor unit adjacent the exit aperture for adjustment transverse to the longitudinal axis to accommodate different size coins without extending the length of the coin passageway.

7. In a coin passageway for conveying coins from a storage container to an exit aperture having a dispenser unit with a member contacting a coin in the coin passageway as the coin is ejected through the exit aperture and a sensor assembly for providing a signal for each ejected coin, the improvement comprising:

means for adjusting the coin passageway to adjust for different diameter coins; and means for moving the dispenser unit transverse to the coin passageway without extending the combined height of the coin passageway and dispenser unit in order to maintain the member in a position within the coin passageway to contact the coin as the coin is ejected and to activate the sensor assembly for each ejected coin.

8. In a coin dispensing apparatus having a coin selector for sending coins along a coin passageway which aligns stacked coins from a storage container to an exit aperture, the improvement comprising:

a dispenser unit having a member for contacting a coin as the coin is ejected through the exit aperture and a sensor assembly for providing a signal for each ejected coin;

a base member for movably mounting the dispenser unit to provide adjustment transverse to a longitudinal axis of the coin passageway without extending the combined height of the passageway; and a fastener member for releasably securing the base member.

9. The invention of claim 8, wherein the base member is a support plate having at least one elongated aperture extending transverse to the longitudinal axis.

10. The invention of claim 9, wherein the coin passageway extends vertically from the storage container and the support plate is mounted at a distal end of the coin passageway relative to the storage container.

11. The invention of claim 8, wherein the sensor assembly includes a pivoting lever for contacting a coin as the coin is ejected.

12. The invention of claim 11, wherein the pivoting lever includes a roller at one end to contact the coin as the coin is ejected.

13. A coin dispensing apparatus comprising:

a storage container for storing coins;

a coin passageway extending along a straight longitudinal axis upward from the storage container to an exit aperture;

a coin selector device for selectively picking up a coin from the storage container and sending the coin to the coin passageway;

a lever pivotally mounted for contacting the coin as it exits the exit aperture;

a sensor unit for counting the coin as it exits the exit aperture; and a mounting assembly for mounting the lever and the sensor unit adjacent the exit aperture, the mounting assembly is movably mounted transverse to the longitudinal axis to accomodate different size coins without extending the combined height of the coin passageway.

14. In a coin passageway for conveying coins from a storage container to an exit aperture having a dispenser unit with a member contacting a coin in the coin passageway as the coin is ejected through the exit aperture and a sensor assembly for providing a signal for each ejected coin, the improvement comprising:

an apparatus for moving the dispenser unit transverse to the coin passageway without extending the combined height of the coin passageway and dispenser unit in order to maintain the member in a position within the coin passageway to contact the coin as the coin is ejected and to activate the sensor assembly for each ejected coin.

* * * * *